US010989465B2

(12) United States Patent
Han

(10) Patent No.: US 10,989,465 B2
(45) Date of Patent: Apr. 27, 2021

(54) REMOVABLE TEMPERATURE SENSITIVE CORE

(71) Applicant: Hongyuan Han, New Vernon, NJ (US)

(72) Inventor: Hongyuan Han, New Vernon, NJ (US)

( * ) Notice: Subject to any disclaimer, the term of this patent is extended or adjusted under 35 U.S.C. 154(b) by 0 days.

(21) Appl. No.: 16/697,453

(22) Filed: Nov. 27, 2019

(65) Prior Publication Data

US 2020/0173721 A1 Jun. 4, 2020

Related U.S. Application Data

(60) Provisional application No. 62/772,822, filed on Nov. 29, 2018.

(51) Int. Cl.
*F25D 31/00* (2006.01)
*B67D 3/00* (2006.01)

(52) U.S. Cl.
CPC ..... *F25D 31/002* (2013.01); *B67D 3/0009* (2013.01)

(58) Field of Classification Search
CPC ..... F25D 31/002; B67D 3/0009
USPC ..... 222/185.1
See application file for complete search history.

(56) References Cited

U.S. PATENT DOCUMENTS 488,473 A * 12/1892 Fruen ..... B67D 3/0009 222/131
1,535,927 A * 4/1925 Look ..... F25D 3/08 137/212
1,572,242 A * 2/1926 Mclaughlin ..... F25D 3/08 62/392
2,685,175 A * 8/1954 Hull ..... F25D 31/002 62/190
5,673,820 A * 10/1997 Green ..... B67D 1/0036 220/510
6,382,089 B1 * 5/2002 Thiffault ..... A47J 19/023 99/506
6,786,361 B2 * 9/2004 Moothart ..... B67D 3/0009 222/113
8,424,448 B2 * 4/2013 Englert ..... A47J 27/21041 99/317
2004/0134932 A1 * 7/2004 Lobdell ..... B67D 3/0009 222/146.5
2013/0056478 A1 * 3/2013 Canales, Jr. ..... F25D 31/002 220/592.03

* cited by examiner

*Primary Examiner* — Vishal Pancholi
(74) *Attorney, Agent, or Firm* — Preti Flaherty Beliveau & Pachios LLP

(57) ABSTRACT

A beverage storage container is described. The beverage storage container includes a removable core containing a viscous temperature sensitive fluid and a containing vessel base configured to hold the temperature sensitive core. The beverage storage container also includes a containing vessel body configured to be in thermal connection with the removable core; and a thermoplastic insulator configured to prevent rapid transfer of temperature between the removable core and the containing vessel body.

18 Claims, 3 Drawing Sheets

REMOVABLE TEMPERATURE SENSITIVE CORE

STATEMENT REGARDING FEDERALLY SPONSORED RESEARCH OR DEVELOPMENT

N/A

BACKGROUND OF THE INVENTION

Various embodiments relate generally to beverage storage systems, methods, devices and computer programs and, more specifically, relate to temperature-controlled beverage storage containers.

This section is intended to provide a background or context. The description may include concepts that may be pursued, but have not necessarily been previously conceived or pursued. Unless indicated otherwise, what is described in this section is not deemed prior art to the description and claims and is not admitted to be prior art by inclusion in this section.

Conventional beverage vessels use various techniques for temperature control, for example, heaters, ice and submerged cooling cores (such as a tube filled with ice). These methods can be messy and/or create potentially harmful situations/fumes.

What is needed is a convenient means to control the temperature within a beverage vessel without the problems associated with the conventional techniques.

SUMMARY

The below summary is merely representative and non-limiting.

The above problems are overcome, and other advantages may be realized, by the use of the embodiments.

In a first aspect, an embodiment provides a beverage storage container. The beverage storage container includes a removable core containing a viscous temperature sensitive fluid and a containing vessel base configured to hold the temperature sensitive core. The beverage storage container also includes a containing vessel body configured to be in thermal connection with the removable core; and a thermoplastic insulator configured to prevent rapid transfer of temperature between the removable core and the containing vessel body.

BRIEF DESCRIPTION OF THE SEVERAL VIEWS OF THE DRAWINGS

Aspects of the described embodiments are more evident in the following description, when read in conjunction with the attached Figures.

DETAILED DESCRIPTION OF THE INVENTION

This patent application claims priority from U.S. Provisional Patent Application No. 62/772,822, filed Nov. 29, 2018, the disclosure of which is incorporated by reference herein in its entirety.

Various embodiments provide new processes and systems for using a removable temperature sensitive core that can be heated or chilled to an appropriate temperature and then placed inside the containing vessel on top of the thermoplastic insulator.

Some advantages of the design are such that the removable core allows the user to only heat or cool the core which is used to replace ice or fuel burning heating units as used in conventional products currently available in the market.

This allows the hot or cold core to be placed inside the containing vessel and permits the user to safely carry the hot or cold core and place the containing vessel directly on any surface without damage. An optional thermoplastic insulator, if used, may prevent the rapid transfer of temperature from the core to the containing vessel adding to the duration the core stays hot or cold and preventing the user from coming in direct contact with the hot or cold surface.

The combination of the removable core with the insulator and containing vessel create a new and unique set of features in how the unit functions distinct from any products currently available in the market today.

Figure 1:
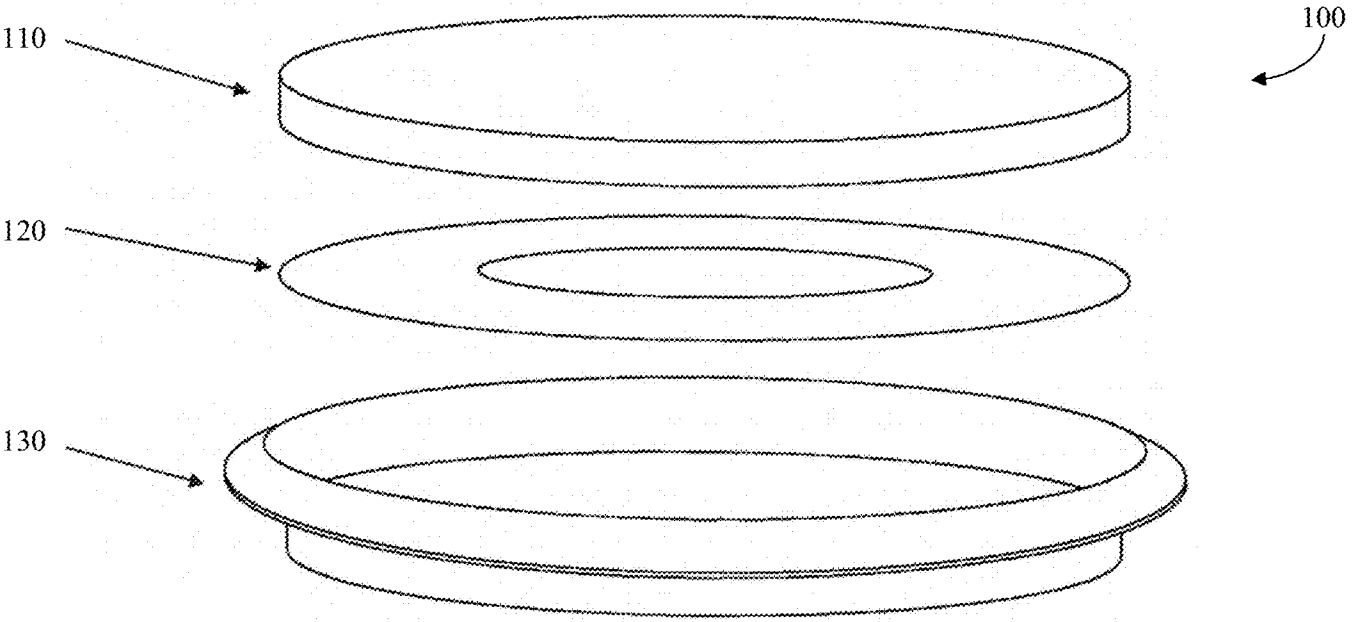
FIG. 1 shows a removable temperature-controlling core in accordance with an embodiment.

FIG. 1 shows a removable temperature-controlling core disc 100 in accordance with an embodiment. The disc 100 includes a removable core 110 which contains a viscous temperature sensitive fluid, such as oil or gel, capable of being placed in the oven, refrigerator, on the table top, etc. A thermoplastic insulator 120 prevents too rapid a transfer of temperature to/from the containing vessel in order to better regulate the thermal conduction. The disc 100 also includes a containing vessel 130 which is the base or holder for the temperature sensitive core disc 100.

Figure 2:
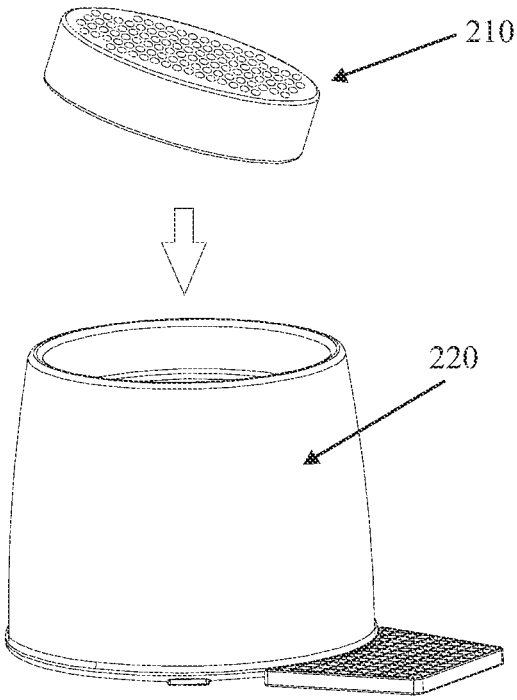
FIG. 2 shows another removable temperature-controlling core being inserted within a beverage storage container base in accordance with an embodiment.
Figure 3:
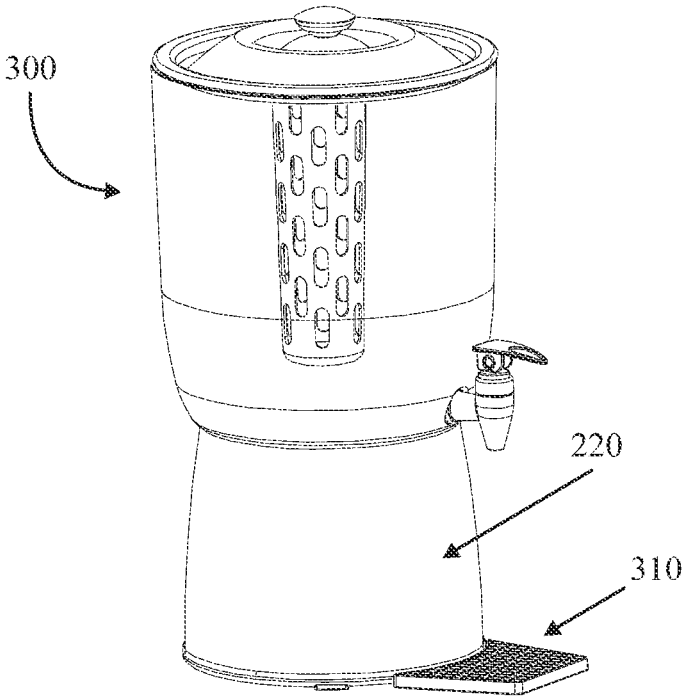
FIG. 3 shows the assembled beverage storage container having the beverage storage container base of FIG. 2.

FIG. 2 shows another removable temperature-controlling core 210 being inserted within a beverage storage container base 220 in accordance with an embodiment. FIG. 3 shows the assembled beverage vessel 300 with the base 220 of FIG. 2. As shown, the assembled beverage vessel 300 includes a drip collector 310.

In a further non-limiting embodiment, the base 220 may be weighed so to provide additional stability to the beverage storage container.

Figure 4:
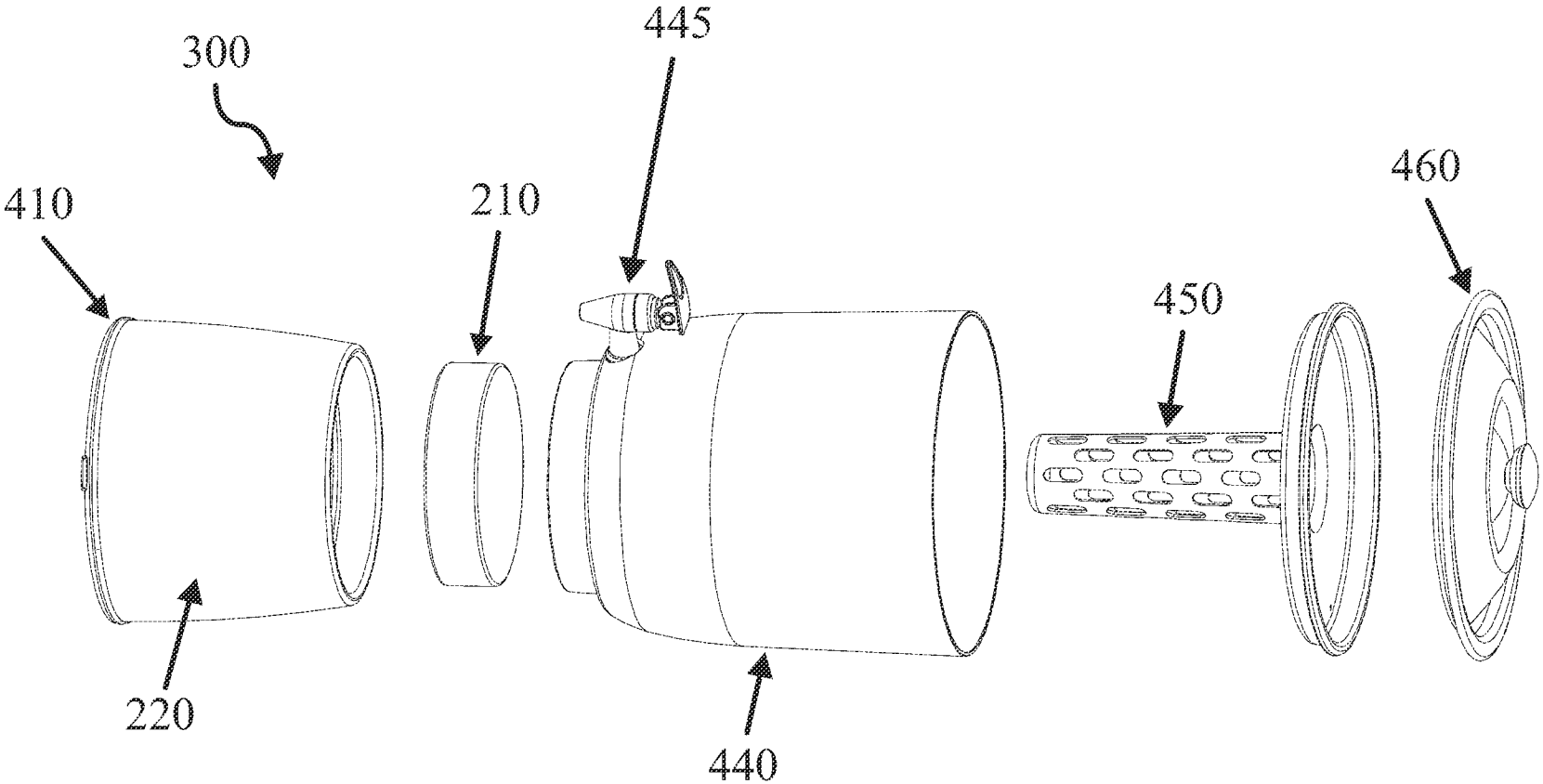
FIG. 4 shows an expanded view of the assembled beverage storage container of FIG. 2.

FIG. 4 shows an expanded view of an assembled beverage storage vessel 300 of FIG. 3. The beverage storage vessel 300 includes an anti-skidding ring (for example, a rubber ring) 410, a base unit 220, a temperature core disc 210, a body 440 configured to hold a beverage, a spout 445, an infuser 450, which is configured to be suspended within the body 440, and a lid 460.

The lid 460 and base 220 may be made of various materials, for example, stainless steel. The body 440 and infuser 450 may be made of various materials, for example, Acrylonitrile Styrene (AS). The spout 445 may be made of various materials, for example, polycarbonate (PC) electroplate. In other non-limiting embodiments, these components may be made of different, suitable materials either alone or in the same matched sets, for example, the base 220 may be made of stainless steel and the lid 460 may be made of plastic.

The infuser 450, which is optional, may be used as a fruit infuser/ice infuser tower.

As shown in FIGS. 2-4, the beverage storage container 300 has a capacity of 3 L. In further non-limiting embodiments, the beverage storage container 330 may have a smaller or large capacity. The same sized core 210 may be used for the different capacities or it may be sized accordingly.

The foregoing description has been directed to particular embodiments. However, other variations and modifications may be made to the described embodiments, with the attainment of some or all of their advantages. Modifications to the above-described systems and methods may be made without departing from the concepts disclosed herein. Accordingly, the invention should not be viewed as limited by the disclosed embodiments. Furthermore, various features of the described embodiments may be used without the corresponding use of other features. Thus, this description should be read as merely illustrative of various principles, and not in limitation of the invention.

What is claimed is:

1. A beverage storage container comprising:

a removable core containing a viscous temperature sensitive fluid;

a containing vessel base configured to hold the temperature sensitive core;

a containing vessel body configured to hold a beverage, wherein the containing vessel base is configured to hold the temperature sensitive core in thermal connection with the containing vessel body; and a thermoplastic insulator configured to prevent rapid transfer of temperature between the removable core and the containing vessel base.

2. The beverage storage container of claim 1, wherein the temperature sensitive fluid is a viscous temperature sensitive fluid.

3. The beverage storage container of claim 1, wherein the temperature sensitive fluid is one of: oil and gel.

4. The beverage storage container of claim 1, wherein the removable core is capable of being independently heated or cooled.

5. The beverage storage container of claim 1, wherein the containing vessel base includes an anti-skidding ring.

6. The beverage storage container of claim 1, wherein the containing vessel base is weighted.

7. The beverage storage container of claim 1, wherein the containing vessel base includes a drip collection surface.

8. The beverage storage container of claim 1, wherein the containing vessel body includes a spout.

9. The beverage storage container of claim 8, wherein the spout is made of polycarbonate electroplate.

10. The beverage storage container of claim 1, wherein the containing vessel body includes an infuser.

11. The beverage storage container of claim 10, wherein the infuser is made of one of: plastic and Acrylonitrile Styrene.

12. The beverage storage container of claim 1, wherein the containing vessel body is made of one of: plastic and Acrylonitrile Styrene.

13. The beverage storage container of claim 1, wherein the containing vessel body includes a lid.

14. The beverage storage container of claim 1, wherein the containing vessel body is made of plastic.

15. The beverage storage container of claim 1, wherein the containing vessel base is made of stainless steel.

16. The beverage storage container of claim 15, wherein the containing vessel body includes a lid made of stainless steel.

17. The beverage storage container of claim 1, wherein the containing vessel base and the thermoplastic insulator are integrated into a single unitary element.

18. The beverage storage container of claim 1, wherein the removable core and the thermoplastic insulator are integrated into a single unitary element.

* * * * *